US008813959B2

(12) United States Patent
Hansen et al.

(10) Patent No.: US 8,813,959 B2
(45) Date of Patent: Aug. 26, 2014

(54) RECLOSABLE DISPLAY PACKAGE

(71) Applicant: Display Pack, Inc., Grand Rapids, MI (US)

(72) Inventors: Victor D. Hansen, Rockford, MI (US); George E. Raimer, Saranac, MI (US); Jared P. Lorenson, Rockford, MI (US); Elliott R. Eckert, Grand Rapids, MI (US); Michael J. Cramblet, Muskegon, MI (US); David A. Korhorn, Rockford, MI (US)

(73) Assignee: Display Pack, Inc., Grand Rapids, MI (US)

( * ) Notice: Subject to any disclaimer, the term of this patent is extended or adjusted under 35 U.S.C. 154(b) by 0 days.

(21) Appl. No.: 13/739,360

(22) Filed: Jan. 11, 2013

(65) Prior Publication Data

US 2014/0197063 A1 Jul. 17, 2014

(51) Int. Cl.
*B65D 73/00* (2006.01)
*B65D 77/22* (2006.01)

(52) U.S. Cl.
CPC ..... *B65D 77/22* (2013.01); *Y10S 206/806* (2013.01)
USPC ..... 206/468; 206/467; 206/806

(58) Field of Classification Search
USPC ..... 206/468, 467, 1.5, 806, 462–465
See application file for complete search history.

(56) References Cited

U.S. PATENT DOCUMENTS 2,937,746 A * 5/1960 Ferguson ..... 206/463
3,111,220 A 11/1963 Donald
3,220,543 A 11/1965 McCord et al.
3,382,972 A * 5/1968 Phipps ..... 206/468
3,464,544 A * 9/1969 Franck ..... 206/468
3,467,248 A * 9/1969 Makowicki ..... 206/465
3,487,919 A 1/1970 Elliott et al.
3,743,081 A 7/1973 Roberg et al.
3,985,289 A 10/1976 Prince
4,083,451 A 4/1978 Hair
4,240,544 A 12/1980 Barnhart et al.
4,266,666 A 5/1981 Kuchenbecker
4,319,684 A 3/1982 Backman et al.
D263,684 S 4/1982 Davis
4,456,124 A 6/1984 Kay et al.

(Continued)

FOREIGN PATENT DOCUMENTS

GB 2091692 A 8/1982

*Primary Examiner* — Anthony Stashick
*Assistant Examiner* — James Way
(74) *Attorney, Agent, or Firm* — Warner Norcross & Judd LLP

(57) ABSTRACT

A reclosable composite package for packaging an article is provided with a tray, a panel and a sliding cover. The tray and cover define a cavity for displaying or packing an article for sale. The tray and panel are configured to define a channel to slidably receive the cover. The tray may have a peripheral flange that includes a raised rail. The panel may be secured with respect to the tray flange and may engage at least a portion of the rail. Interaction between the rail and the panel during manufacture or assembly of the package may create a space between the tray and the panel to form the channel. The cover may be inserted within the channel formed by the tray flange, rail and panel. In use, the cover may slide within the channel to selectively open and close the package. The package may include one or more catches, stops or snap lock features to further secure and stabilize the package.

25 Claims, 13 Drawing Sheets

(56) References Cited

U.S. PATENT DOCUMENTS

| | | | | |
|---|---|---|---|---|
| 4,463,893 | A * | 8/1984 | Brunone et al. | 229/102 |
| 4,498,589 | A | 2/1985 | Scott et al. | |
| 4,499,353 | A | 2/1985 | Shields | |
| 4,635,797 | A | 1/1987 | Bankier | |
| 4,666,037 | A | 5/1987 | Weissman | |
| 4,724,957 | A | 2/1988 | Burgschweiger | |
| 4,739,883 | A | 4/1988 | Mohs et al. | |
| 4,779,734 | A | 10/1988 | Kydonieus | |
| D305,000 | S | 12/1989 | Hernandez | |
| 4,884,718 | A | 12/1989 | Leahy | |
| 4,892,195 | A | 1/1990 | Slavin et al. | |
| 4,901,884 | A | 2/1990 | Kallenbach | |
| 5,092,479 | A | 3/1992 | Wells | |
| 5,568,863 | A | 10/1996 | Weavers | |
| D376,314 | S | 12/1996 | Krupa | |
| 5,595,300 | A | 1/1997 | Paik et al. | |
| 5,769,217 | A | 6/1998 | Derraugh et al. | |
| 5,775,512 | A | 7/1998 | Jones et al. | |
| 5,775,516 | A | 7/1998 | McCumber et al. | |
| 5,839,575 | A | 11/1998 | Blanco | |
| D407,015 | S | 3/1999 | Jones | |
| D411,448 | S | 6/1999 | Baker | |
| 5,944,177 | A * | 8/1999 | Nemoto | 206/232 |
| D420,905 | S | 2/2000 | Adkins | |
| 6,053,321 | A | 4/2000 | Kayser | |
| 6,230,964 | B1 | 5/2001 | Saito | |
| 6,237,772 | B1 | 5/2001 | LaMarche et al. | |
| 6,244,444 | B1 | 6/2001 | Jacobus et al. | |
| D448,288 | S | 9/2001 | Zettle et al. | |
| 6,308,832 | B1 | 10/2001 | Pirro et al. | |
| 6,311,845 | B1 | 11/2001 | Uren et al. | |
| 6,364,115 | B1 | 4/2002 | Casanova et al. | |
| 6,523,689 | B2 * | 2/2003 | Mickel | 206/468 |
| D479,127 | S | 9/2003 | Jowett | |
| 6,715,607 | B2 | 4/2004 | Wetsch | |
| 6,959,809 | B2 | 11/2005 | Begim | |
| D531,028 | S | 10/2006 | Weiss et al. | |
| D534,421 | S | 1/2007 | Tanner | |
| 7,258,233 | B2 | 8/2007 | Lee | |
| D553,489 | S | 10/2007 | Lambert et al. | |
| D600,113 | S | 9/2009 | Edwards et al. | |
| D601,014 | S | 9/2009 | Petijean | |
| 7,621,405 | B2 | 11/2009 | Schweitzer et al. | |
| D606,392 | S | 12/2009 | Prevost | |
| D615,858 | S | 5/2010 | Prevost | |
| D624,399 | S | 9/2010 | Hansen et al. | |
| D624,402 | S | 9/2010 | Hansen et al. | |
| D624,403 | S | 9/2010 | Hansen et al. | |
| D624,815 | S | 10/2010 | Hansen et al. | |
| D634,616 | S | 3/2011 | Hansen et al. | |
| 7,931,148 | B2 | 4/2011 | Hansen et al. | |
| 8,381,908 | B2 | 2/2013 | Hansen et al. | |
| 8,459,460 | B1 | 6/2013 | Hansen et al. | |
| 8,496,111 | B2 | 7/2013 | Hansen et al. | |
| 2002/0195363 | A1 | 12/2002 | Tuneberg | |
| 2004/0163990 | A1 | 8/2004 | Begim | |
| 2005/0173286 | A1 | 8/2005 | Hansen | |
| 2006/0016711 | A1 | 1/2006 | Ritter | |
| 2006/0042986 | A1 | 3/2006 | Simkowski | |
| 2007/0163911 | A1 | 7/2007 | Gelardi | |
| 2008/0118609 | A1 | 5/2008 | Harlfinger | |
| 2010/0314279 | A1 | 12/2010 | Hansen et al. | |
| 2011/0168731 | A1 | 7/2011 | Hansen et al. | |
| 2011/0290675 | A1 | 12/2011 | Shiue et al. | |
| 2012/0325713 | A1 | 12/2012 | Cramblet et al. | |
| 2013/0062342 | A1 | 3/2013 | Hansen et al. | |
| 2013/0161220 | A1 | 6/2013 | Hansen et al. | |

* cited by examiner

RECLOSABLE DISPLAY PACKAGE

BACKGROUND OF THE INVENTION

The present invention relates to packaging, and more particularly to point-of-sale product packages.

A wide variety of products intended for retail sale are packaged in packaging that includes plastic components. One of the most common forms of plastic point-of-sale packages is a blister package. A typical blister package includes a shaped plastic blister that forms the main cavity of the package and a backer panel that closes the cavity. The backer panel is often sealed to the blister, for example, by adhesive to enclose the product within the cavity. The backer panel may be formed from paperboard, plastic, aluminum or other similar materials. Because of the use of a paperboard backer panel, a blister package has the potential to be a relatively low cost packaging solution. The amount of plastic used to contain the product is relatively small and the backer panel can be sized to provide ample space for printed content. A conventional blister package includes a plastic component (or blister) having a peripheral flange that is face-sealed to a paperboard card or sandwiched between a pair of paperboard panels. In some cases, the two paperboard panels are a single piece of paperboard folded along an edge. In other cases, they are two separate panels. Various attempts have been made to provide recloseable blister packages. In one type of recloseable blister package, the blister is formed with an integral door. With this construction, the blister remains sealed to the paperboard and a door within the blister is opened. In another type of recloseable blister package, the blister is secured to the paperboard in a way that allows the blister to pivot away from the paperboard. For example, one edge of the blister may be permanently sealed to the paperboard and the other three edges may be joined only by a peelable adhesive. This allows the blister to open while remaining joined to the paperboard. In another example, one edge of the blister may be adhered to the paperboard while another portion of the blister is snap-fitted to a portion of the paperboard leaving at least a portion of the blister without an adhesive or mechanical connection to the paper board. The snap-fit portion can be fitted or unfitted allowing the package to be opened and reopened a number of times. In yet another example, the paperboard panel closing the blister may include a door, such as a perforated region that can be opened to gain access to the interior of the blister.

Another common form of plastic point-of-sale package is a clamshell package. A typical clamshell package includes a pair of formed plastic parts (often "halves") that are joined along a hinge. The parts can be closed about the hinge to entrap the product to be packaged. Clamshell packages vary dramatically in design and configuration. For example, some clamshell packages are sealed shut to protect the contents of the package until it is opened, while other clamshell packages are resealable. With sealed clamshell packages, it is often necessary to at least partially destroy the package to gain access to the contents. In a resealable configuration, the clamshell can be formed with contours that permit the two clamshell parts to be friction interfitted in a way that holds the parts together in a closed configuration about the packaged contents. It is not uncommon to incorporate paper or paperboard inserts into clamshell packages. For example, information and other content can be printed on an insert that is enclosed within the clamshell.

In some applications, a hybrid clamshell package is formed by securing paperboard panels or other similar materials around the peripheral edges of the clamshell. The hybrid package provides, among other things, the added advantage of additional space for additional printed content. Although it enjoys some benefits, the presence of the hinge in the clamshell presents a challenge to hybrid package construction. Conventional constructions provide two options for dealing with the hinge. In one type of construction, the hinge is trapped between the paperboard panels. This provides a strong package because the clamshell is joined to the paperboard around its entire periphery. However, because the hinge is positioned between the paperboard panels, opening and closing of the package forces the paperboard apart, which can cause the paperboard to buckle and tear near the hinge. This problem can be exacerbated with repeated opening and closing of the blister. The peeling and tearing of the paperboard can ultimately break the connection between the paperboard and the blister, which can weaken the package and impact its aesthetic appearance. The second type of hybrid construction includes paperboard panels that are shaped so that they do not entrap the hinge. This prevents the issues of buckling and tearing discussed above, but provides a somewhat weaker package because the clamshell and paperboard panels are not laminated along the hinge.

In order to overcome the issues associated with the weakening, buckling or tearing of the paperboard (as well as to provide other advantages), some hybrid clamshell packages have been developed to include multiple hinges. For example, a multiple hinge package is shown in U.S. Pat. No. 7,931,148 to Hansen. In these types of packages there is a hinge that allows the clamshell package to be secured together in paperboard and another hinge that allows the package to open and close without disturbing the paperboard.

There are a variety of types of composite packages in which the paperboard and plastic components are combined in different ways. For example, "book-style" composite packages are known to include an inner plastic clam shell that forms a compartment to contain the article(s) to be packaged and an outer paperboard cover that covers the clam shell. The clam shell and paperboard each include an integral "spine." The spines are generally coextensive to allow the package to be opened and closed along one edge in a book-like manner. Book-style composite packages provide the benefits of being easily recloseable and relatively stable constructions, but they can be relatively expensive to manufacture. Further, the paperboard spine, which spans the thickness of the package, may be too flexible to provide confident registration between the clam shell portions, particularly after repeated opening and closing.

Packages without the coextensive paperboard and plastic spines have been developed to address several issues including the challenge presented by the book-style composite packages described above. These packages include hinged paperboard panels with openings that seat two opposing plastic components that meet to form a product cavity when the paperboard panels are folded together along the hinge.

Although existing composite packages are suitable for many applications, there remains a desire for a stable and easily reclosable package that is less expensive to manufacture and provides a wide range of packaging options.

SUMMARY OF THE INVENTION

The present invention provides a reclosable composite display package having a tray, a panel and a sliding cover. The tray and cover may collectively define a cavity to hold and display an article for sale. The tray and panel are arranged to cooperatively define a channel that slidably receives the cover. In use, the cover can be slidably moved within the channel to allow the package to repeatedly opened and closed. In one embodiment, the tray and panel are joined to one another and are configured to form the channel automatically as they are joined. For example, the tray and panel may be configured so that the panel is shaped to by interaction with the panel to form the channel.

In one embodiment, the channel is formed by interaction of the panel with the flange of tray. In one embodiment, the panel includes two sides that are joined together around the outer peripheral edge of the tray flange. The thickness of the tray flange may cause one side of the panel to bend slightly as the two sides of the panel close around the tray flange. The bending of the panel results in a channel being formed on one side of the tray flange. In one embodiment, the thickness of the tray flange is effectively increased by providing the tray flange with a rail. The rail may be located along the outer peripheral edge of portions of the tray flange. The flange may include a rail that interacts with and causes a portion of the panel to be spaced away from the tray flange to form the channel.

In one embodiment, channel guides are included to facilitate insertion of the cover into the channel. The channel guides may be flaps, notches, slits or perforations in the panel to allow a subtle separation from the tray flange for ease of inserting the cover in the channel. In one embodiment, the separation is caused by the rail or thickness of the peripheral tray flange. The ease of the start of the cover into the channel is due to the cover being in a position to engage the channel, or be woven into the channel guides, prior to encountering a ramp, if present, on the tray.

In some embodiments, the package may include additional features intended to ease the cover into place by providing a leading edge to the cover with a notch formed therein. Further, formation of the notch allows the leading corners of the cover to move through the channel toward the bottom end of the package and to seat in a closed position while avoiding or minimizing buckling, wrinkling or tearing of the panel material.

In some embodiments, the cover is snap-fitted to the tray by providing one or more pairs of ramps and corresponding depressions on the cover and tray that snap together to securely maintain the package in a closed position. The characteristics of the ramp and depression of the snap-fit elements, such as the number, size, shape, and length may vary to provide the desired resistance to close or undo engagement between the snap-fit elements.

In one embodiment, the package may include a hang hole and the tray flange may be configured to reinforce the hang hole. In this embodiment, the hang hole may be located toward the top of the package and the tray flange may be shaped to extend above the hang hole to reinforce the panels against tearing initiated at the hang hole. The tray flange may be shaped to extend completely around the hang hole, if desired.

The package may be constructed by assembling the panel and the tray. The cover may remain separate until the reclosable package is ready to be filled with articles for sale. The cover can be easily placed on the package without additional equipment or special skill by the individual filling the package. A large number of panel-tray assemblies can be nested together then boxed and shipped. Similarly, a large number of covers can be stacked together and boxed separately from the panel-tray assemblies. Due to the large number of covers that can be stacked and shipped in a relatively small box, the overall cost of shipping of the reclosable packages can be minimized.

The present invention provides a simple and inexpensive display package with a cover that slides along a channel formed by a tray and panel. The package is easily opened and closed by a consumer interested in gaining access to the packaged article(s). For example, the package allows a potential customer to inspect the packaged article(s) at the point of sale. It also allows a customer to more easily access article(s) once purchased. The package can be initially loaded with product and assembled without the need for expensive sealing equipment. The described benefits should not be interpreted to limit the invention in any way.

These and other objects, advantages and features of the invention will be more readily understood and appreciated by reference to the detailed description of the invention and the drawings.

DETAILED DESCRIPTION OF CURRENT EMBODIMENTS

Figure 1:
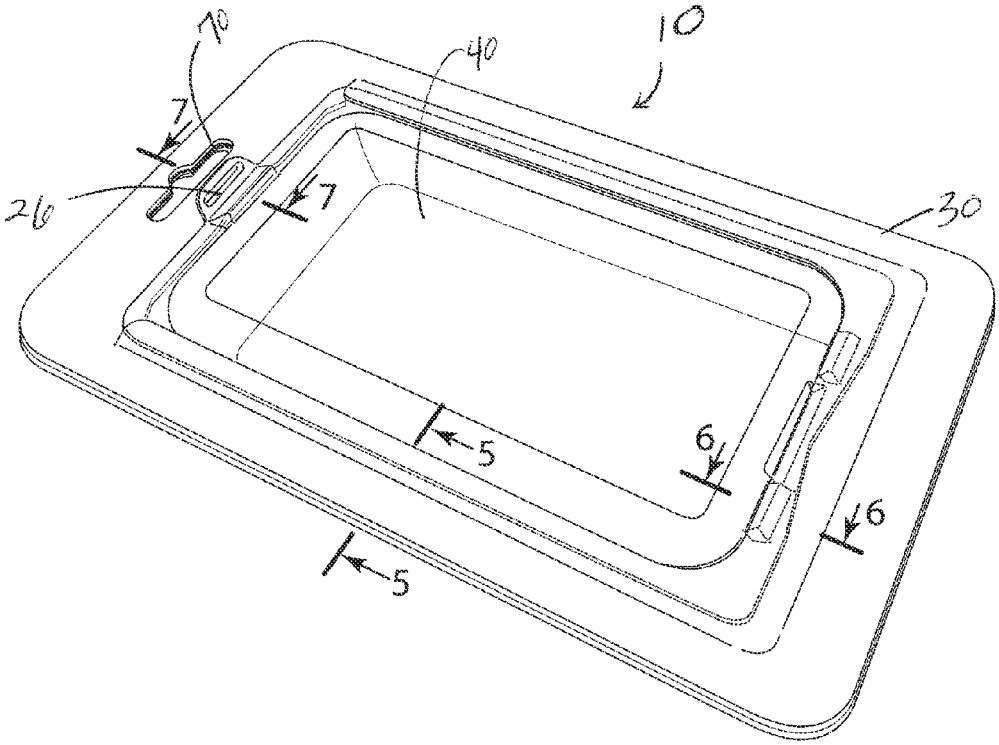
FIG. 1 is a perspective view of the recloseable package in accordance with an embodiment of the present invention.
Figure 2:
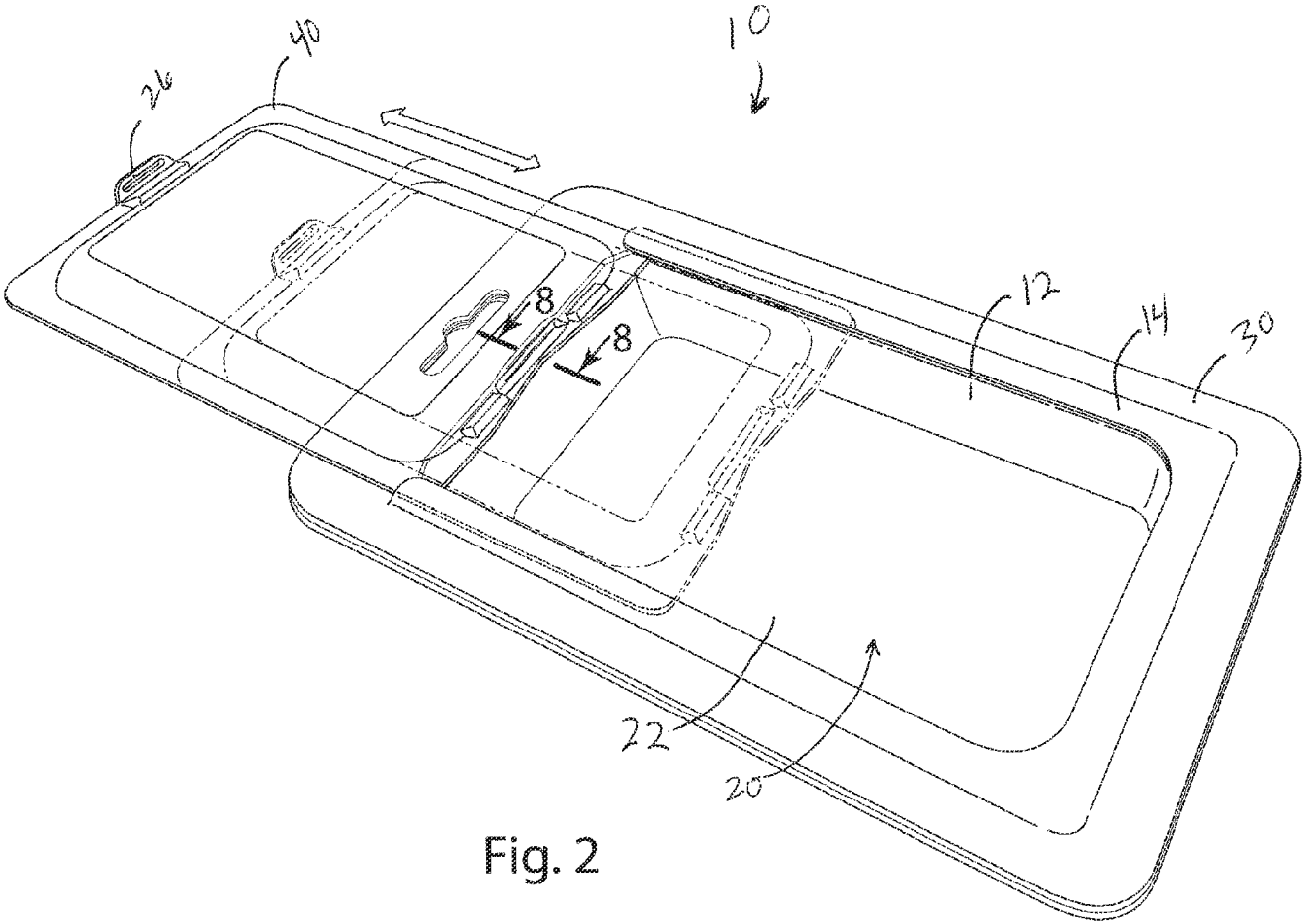
FIG. 2 is a perspective view of the package in a partially open and fully open position.
Figure 3:
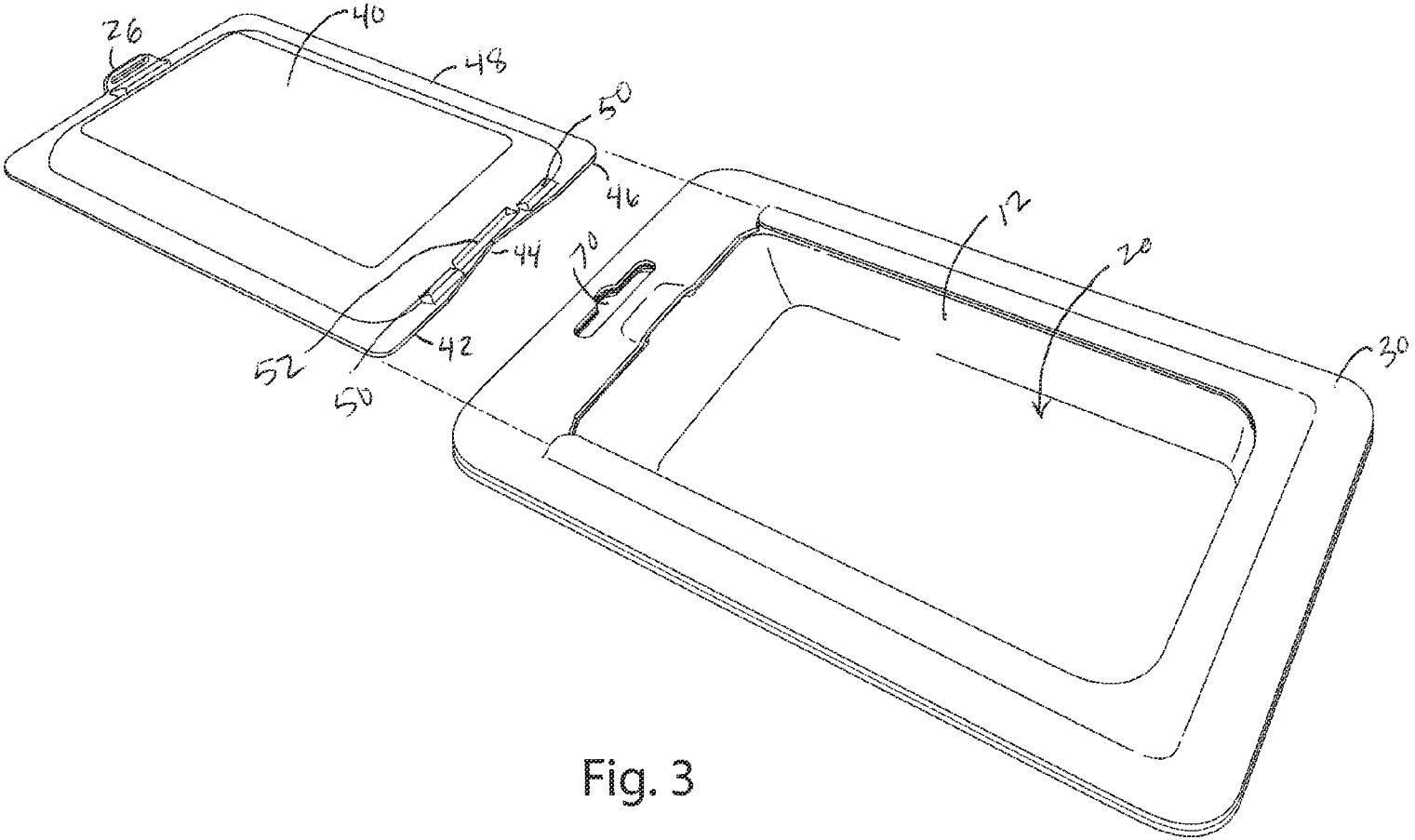
FIG. 3 is a perspective view of the package with the cover off.

A reclosable display package in accordance with an embodiment of the invention is shown in FIGS. 1-3 and is generally designated 10. The reclosable package 10 of this embodiment is designed to hold and display articles for sale and generally includes a tray 12, a panel 30 and a cover 40. In the embodiment of FIGS. 1-3, the tray 12 includes a peripheral tray flange 14 having a rail 16 about at least a portion of the peripheral tray flange 14 and a hang hole 70. A substantially inner or concave portion 22 of the tray 12 serves as a cavity 20 for containing and displaying a product. As seen in the cross-section of FIG. 5A, the panel 30 is secured about at least a portion of the peripheral tray flange 14 and is shaped by the rail 16 to form a slot or channel 18 between the panel 30 and the tray 12 adapted to closely receive and guide the cover 40. In this embodiment, the thickness of the channel 18 is equal or greater than the thickness of the panel 30.

In the illustrated embodiment, the package 10 is a composite package formed from a polymer tray, a polymer cover and a paperboard panel (or panels). For example, the tray 12 and cover 40 of the package 10 may be molded or thermoformed and are typically constructed from polyvinyl chloride (PVC) or polyethylene terephthalate (PET) or some other polymer. Although the tray 12 and cover 40 are typically transparent, translucent or clear, they may also be opaque, clouded or tinted any suitable color. For standard applications, the tray 12 and cover 40 are likely to have a thickness ranging between 12 and 30 gauge (i.e., 12 to 30 thousands of an inch) with a typical thickness of about 20 mils. The tray 12 and/or cover 40 may alternatively be manufactured from fully or partially recycled materials such as paper pulp material that is made at least in part from waste paper and is biodegradable. The tray 12 or cover 40 may be formed by molding pulp, such as wood pulp or other natural fiber pulp, into a desired shape.

The panel 30 can be constructed of paperboard material with 20 point paperboard being typical and may be manufactured from a recycled paper pulp product. Although the package 10 is well-suited for use with a panel 30 formed from a paper pulp material, the panel 30 may be manufactured from other materials, such as plastic, when desired. For example, the panel 30 may be thermoformed from a suitable plastic material, such as PVC or PET.

Figure 4:
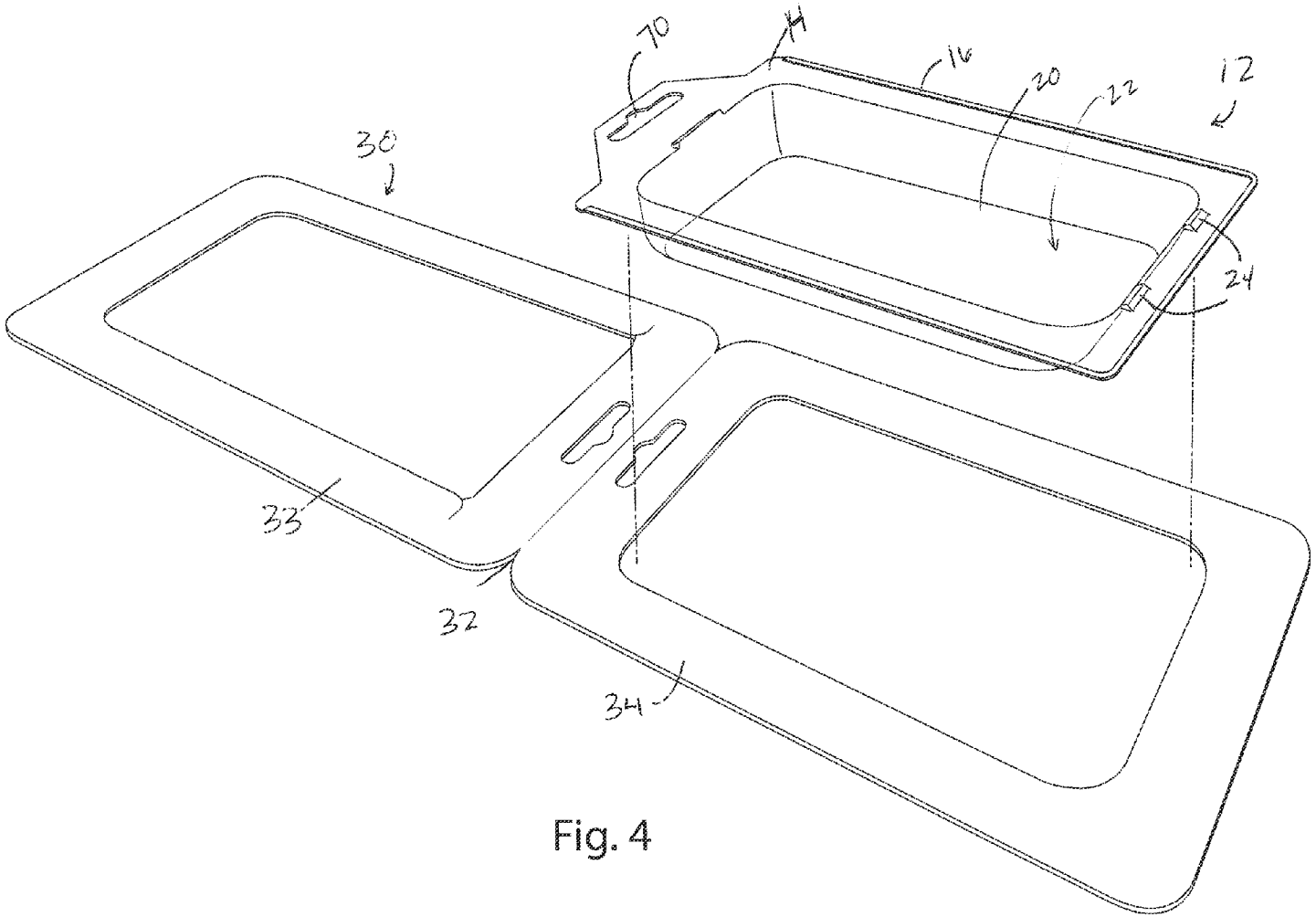
FIG. 4 is a partial exploded view of the package with folded paperboard panel.

As shown in FIG. 4, the panel 30 is folded at a hinge 32 and sandwiches the tray flange 14 between opposing panel sides 33 and 34. The opposing panel sides 33 and 34 are, among other things, adapted to close about and retain the peripheral tray flange 14. The panel sides 33 and 34 also provide a surface that can receive printed material, such as text and images. In the illustrated embodiment, the panel sides 33 and 34 are adapted to sandwich the peripheral tray flange 14. The panel sides 33 and 34 may surround the tray flange 14 entirely, as shown, or some smaller portion of the peripheral tray flange 14 if desired. While FIG. 4 shows an integrally formed panel 30 with opposing side panels 33 and 34 defined by a hinge 32, the panel 30 may be formed by separate pieces that are joined together after being closed around at least a portion of the peripheral tray flange 14. The panel sides 33 and 34 may be secured together in any suitable manner, including adhesives, cements, cohesive agents or mechanical means known in the art. Adhesive or cohesive materials include (but are not limited to) several options such as rubber, latex, heat activated adhesive, heat seal coating, standard glue, hot melt glue, single-sided tape, double-sided tape or a radio frequency ("RF") activated adhesive. Alternatively, the panel sides 33 and 34 can be secured together by mechanical means including, but not limited to, staples, rivets, grommets, push-lock pins, or crimping. These and other options (alone or in combination) may be used to join the panel sides 33 and 34. The panel sides 33 and 34 can be any desired size and shape depending on any number of relevant factors, such as desired aesthetics and the characteristics of the article(s) to be packaged (e.g. number, size, shape and weight). Generally, the panel 30 is secured around the peripheral tray flange 14 by attaching together the opposing sides 33 and 34 together with an adhesive material without applying an adhesive to the peripheral tray flange 14. This configuration provides improved recyclability of the materials used to manufacture the display package 10 because the plastic portions of the package 10, for example, the tray 12 and cover 40, can be separated from a paper board panel 30 without leaving paper or adhesive residue on the plastic tray 12 or cover 40. Alternatively, the panel 30 may be adhered directly to, or mechanically attached to, the peripheral tray flange 14 by the means described above for attaching together the opposing panel sides 33 and 34 or by other means known in the art.

In the illustrated embodiments, the tray 12 and cover 40 are separate elements. If desired, the tray 12 and cover 40 alternatively may be formed together from a continuous piece of material. For example, in this alternative embodiment, the tray 12 and cover 40 may be joined by small lands (not shown) of material that keep the two components together until the lands are broken. In use, the lands may function as a living hinge to allow the cover 40 to be folded over onto the tray 12. When the cover 40 is opened for the first time, the lands (not shown) may be broken by the user to allow the cover 40 to slide into the open position. The number, size, shape and configuration of the land (or lands) may be selected to balance the strength of the connection between the cover 40 and the tray 12 with the amount of force required to break the land(s) to initially open the package 10.

Although not shown, the package 10 may include one or more wafer seals (not shown) to provide a tamper-evident or tamper-resistant mechanism that seals the cover 40 in the closed position. For example, the wafer seal(s) may be self-adhesive stickers that can be placed over the edge of the cover 40 and the panel 30. The characteristics of the wafer seal(s) (e.g. substrate material and adhesive characteristics) may be selected so that it is difficult to separate the wafer seal(s) from the package.

Figure 5A:
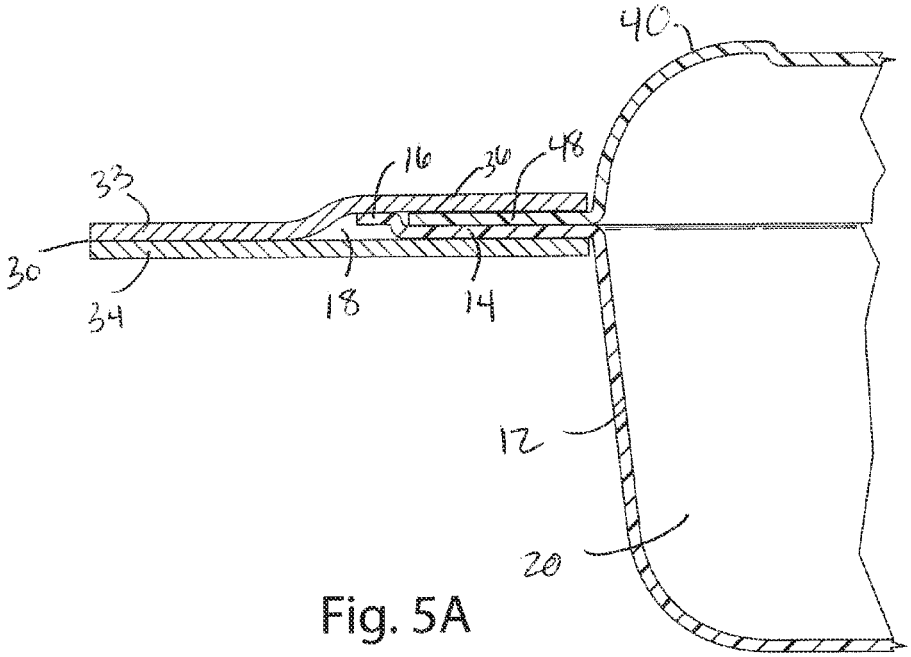
FIG. 5A is a cross-sectional view of the mid-section of the package shown in FIG. 1.
Figure 5B:
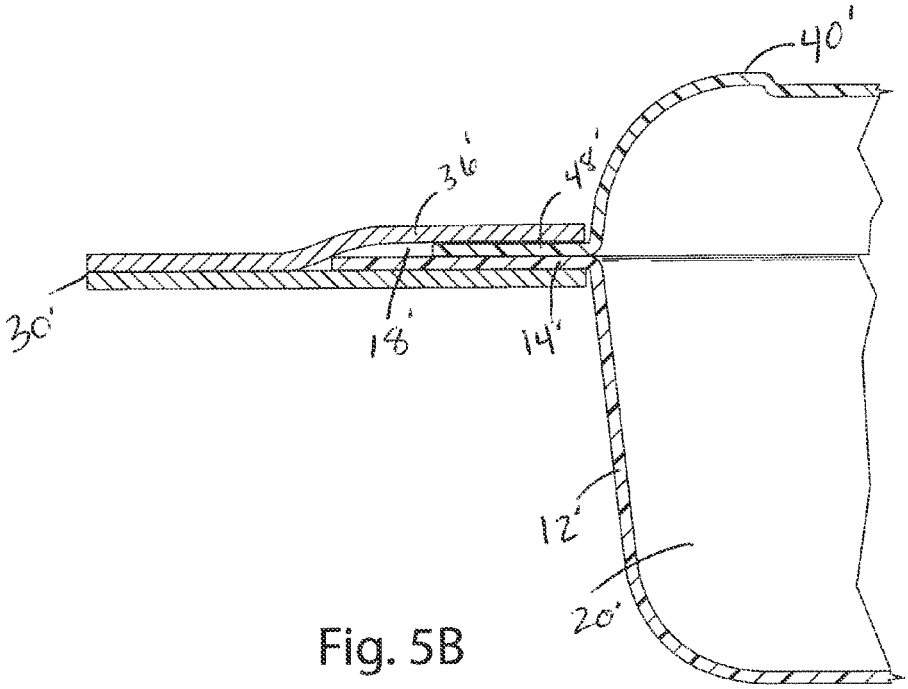
FIG. 5B is a cross-sectional view of the mid-section of the package shown in FIG. 1 with no rail.

In the cross-sectional view of FIG. 5A, the panel 30 is folded paperboard adhered together entrapping the tray flange 14 therebetween. An upper portion 36 of the panel 30 bends about the rail 16 causing an inner portion of the panel 30 to be spaced apart from the tray 12 thereby creating a channel 18 defined by the surfaces of the tray flange 14, the panel 30 and the rail 16. An alternative embodiment without the rail is shown in FIG. 5B. In this alternative embodiment, the thickness of the peripheral tray flange 14' may provide a deep enough profile against the upper portion 36' of the panel 30' to create a channel 18' to receive the cover 40'. In another alternative embodiment, the rail is an integrally formed on the panel. For example, the paperboard panel could be embossed when it is die cut to include a rail. Therefore, the rail may be integral to either the panel 30 or the peripheral tray flange 14, or the channel 18 may be formed with the thickness of the peripheral tray flange serving the role of the rail.

As best depicted in FIGS. 2 and 3, the cover 40 functions as a recloseable sliding door by moving within the channel 18 over a range of positions from a completely closed cavity 20 containing a product to a completely open cavity 20 allowing for easy placement or replacement of the product within the package 10. The illustrated embodiment includes a peripheral cover flange 48. However, the cover may be molded or pressed in a flat arrangement without a flange. In this embodiment, the position of the cover 40 may be changed without disturbing the position of the panel 30.

Figure 6:
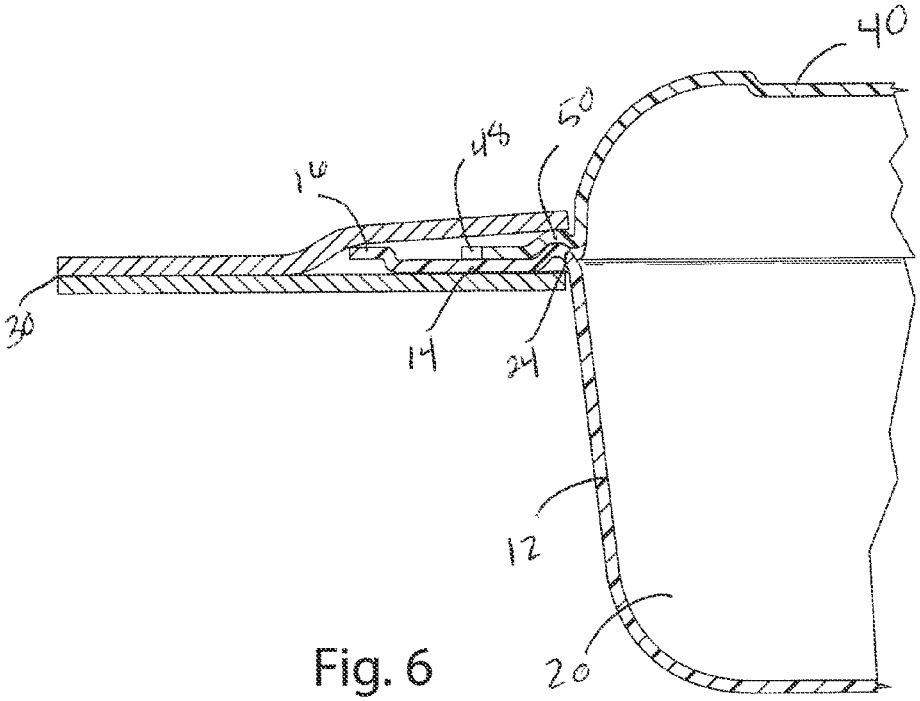
FIG. 6 is a cross-sectional view of the bottom catch of FIG. 1.
Figure 7:
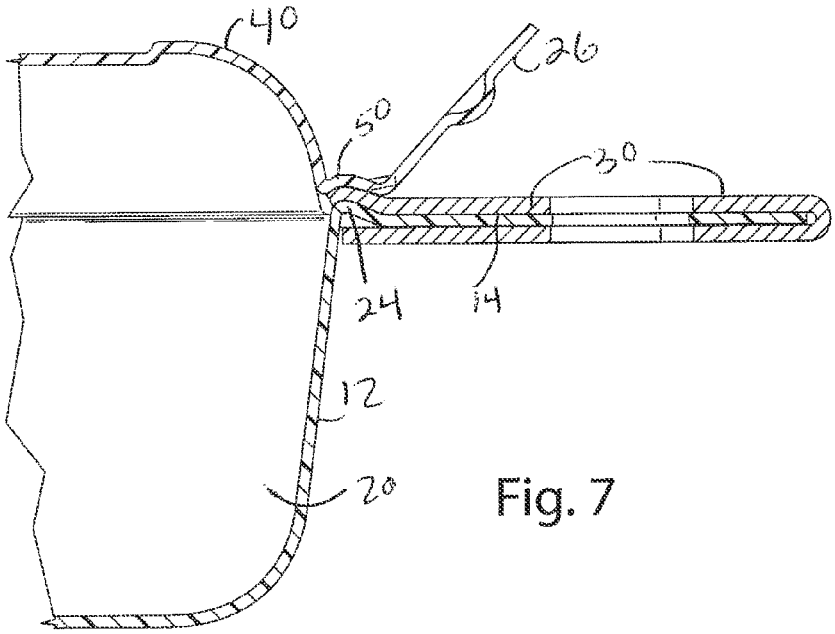
FIG. 7 is a cross-sectional view of the finger tab of FIG. 1.
Figure 8:
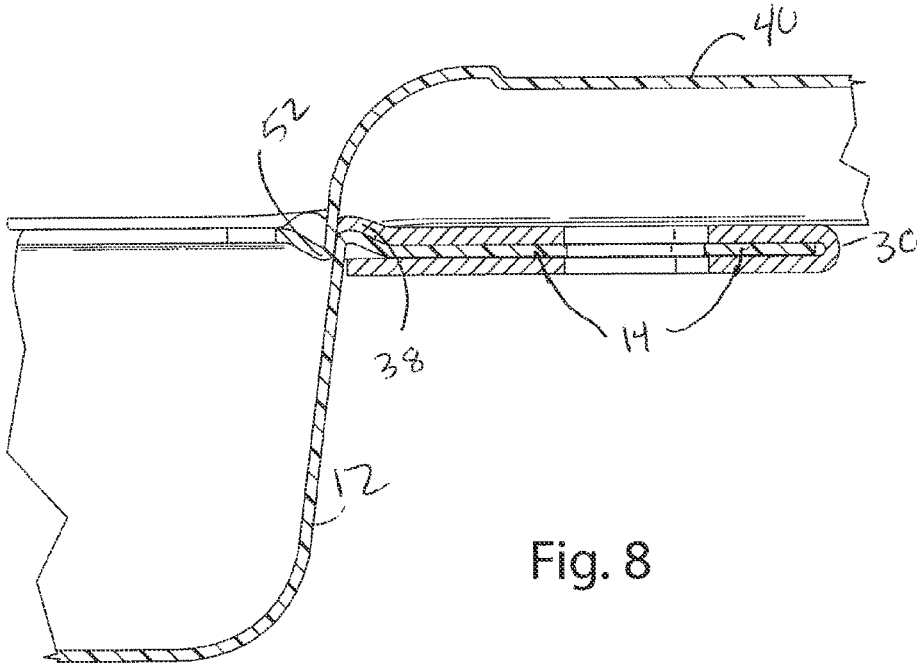
FIG. 8 is a cross-sectional view of the bottom stop of FIG. 1.

The cover 40 may be secured or guided into position within the package 10 by providing stops or catches on the tray flange 14, on the cover flange 48 or both that would meet or snap into corresponding voids in the other flange 14 or 48. The meeting of the stops or catches with the corresponding voids provides tactile confirmation to the user of the package that the cover 40 is securely in place. Referring to the cross-sectional views of FIG. 6-8, the tray flange 14 includes ramps 24 that meet and snap lock into corresponding depressions 50 in the cover flange 48. The stops, catches or ramps 24 may be included on the package 10 as one or more small ramps 24 as shown in FIGS. 6-8 or may alternatively be a single, longer or multiple catches. While the illustrated embodiment includes the ramps 24 on the peripheral tray flange 14 and the depression 50 on the peripheral cover flange 48, it should be understood that the position of the ramp(s) and depression(s) could be reversed so that the ramp(s) are on the peripheral cover flange 48 or cover 40 and the depression(s) are on the peripheral tray flange 14. The steepness of the ramps 24 and the depth of the depressions 50 may vary, for example, to control the amount of force desired to snap the ramps 24 and depressions 50 together or to undo their connection and reopen the package 10. The snap elements of this embodiment are the ramps 24 of the peripheral tray flange 14 and corresponding depressions 50 on the peripheral cover flange 48 of the cover 40. By virtue of the interference fit, the ramps 24 interact with the depressions 50 on the cover 40 when the package 10 is opened or closed. The number of snap elements such as ramps 24 or depressions 50 may vary and they may be positioned in essentially any desired location on either the peripheral tray flange 14, on the peripheral cover flange or on the cover 40. The characteristics of the ramps 24 and depressions 50, such as the number, location, shape and/or length of the snap elements, may be varied to provide the stiffness desired to maintain a snap-fit between the ramps 24 and depressions 50. For example, longer or shorter ramps 24 and/or depressions 50 may vary the overall force required to snap-fit the cover 40 into the closed position. For example, in the illustrated embodiment, the leading and closing edges of the ramps 24 and/or depressions 50 may be non-planar to provide some control over the interaction between these elements. The leading edge of a ramp can vary in steepness to provide more or less resistance when snap fitting into the depression. As another example, the trailing edge of a ramp can be squared to provide increased resistance to opening of the package. Alternatively, or additionally, the characteristics of the interfacing portions of the snap elements, such as size or shape, may be varied to control the force required to operate the snap-fitting interaction of the ramps 24 and corresponding depressions 50.

Figure 14:
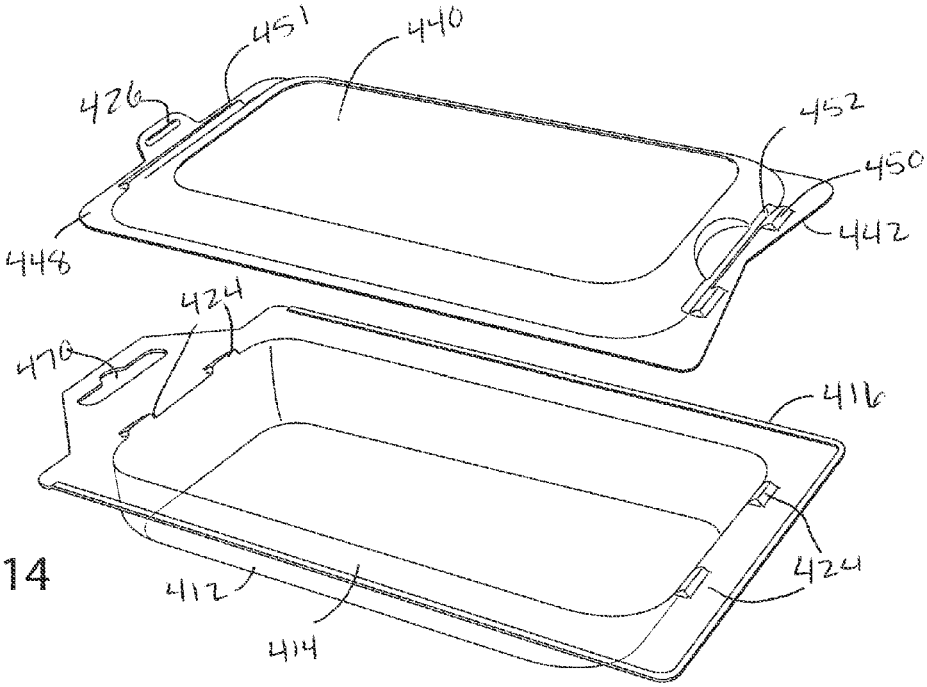
FIG. 14 is a perspective view of an alternative, double catch arrangement.
Figure 15:
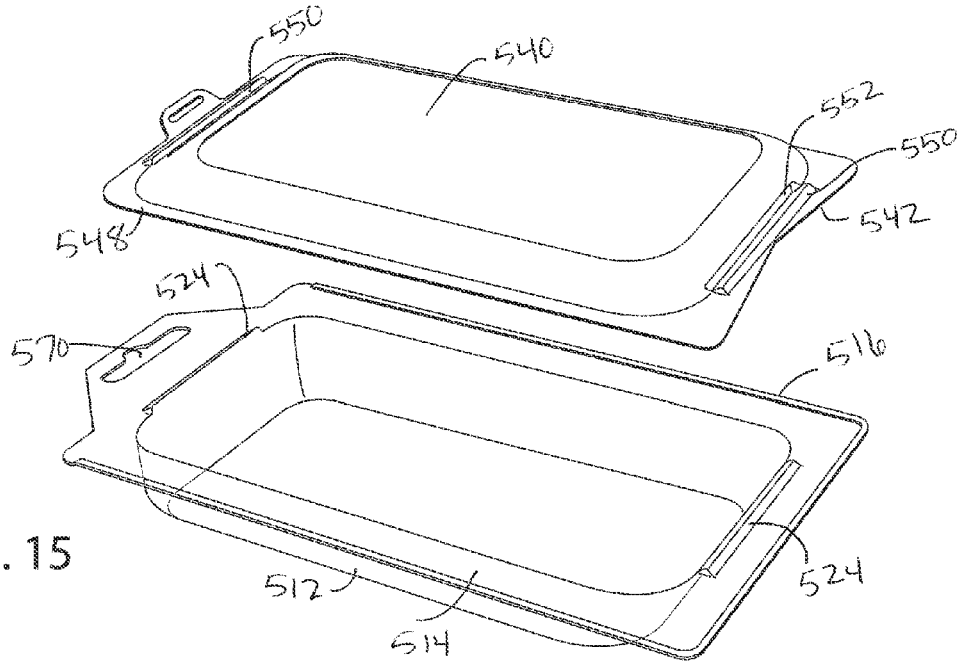
FIG. 15 is a perspective view of an alternative, single catch arrangement.

FIGS. 14 and 15 show examples of varying numbers and lengths of the ramp(s) and corresponding depression(s) that form the snap lock feature. In FIG. 14 several ramps 424 are provided on the peripheral tray flange 414. Corresponding depressions 450 near a leading edge 442 of the cover 440 are provided to closely match the length of ramps 424. The snap lock feature may also be accomplished when the depression 451 has a longer length than the ramp 424. FIG. 15 depicts the tray 512 with a longer ramps 524 that correspond to longer depressions 550 in the in the cover 540 as compared to the ramps 424 of FIG. 14.

Stops or catches without corresponding depressions may also be used and would aid in the positioning of the cover 40 by stopping on contact with a panel 30 or an edge of the tray 12. For example in FIG. 8, the cover 40 may include a bottom stop 52. When the package 10 is in the open position as shown in FIG. 8, the bottom stop 52 meets with a upper back portion 38 of the panel 30 to prevent the cover 40 from being completely removed from the package 10 without pivoting the cover so that the stop 52 disengages the upper back portion 38 of the panel 30. Similar stops are shown in FIGS. 14 and 15 and are referenced as 452 and 552, respectively.

Figure 12:
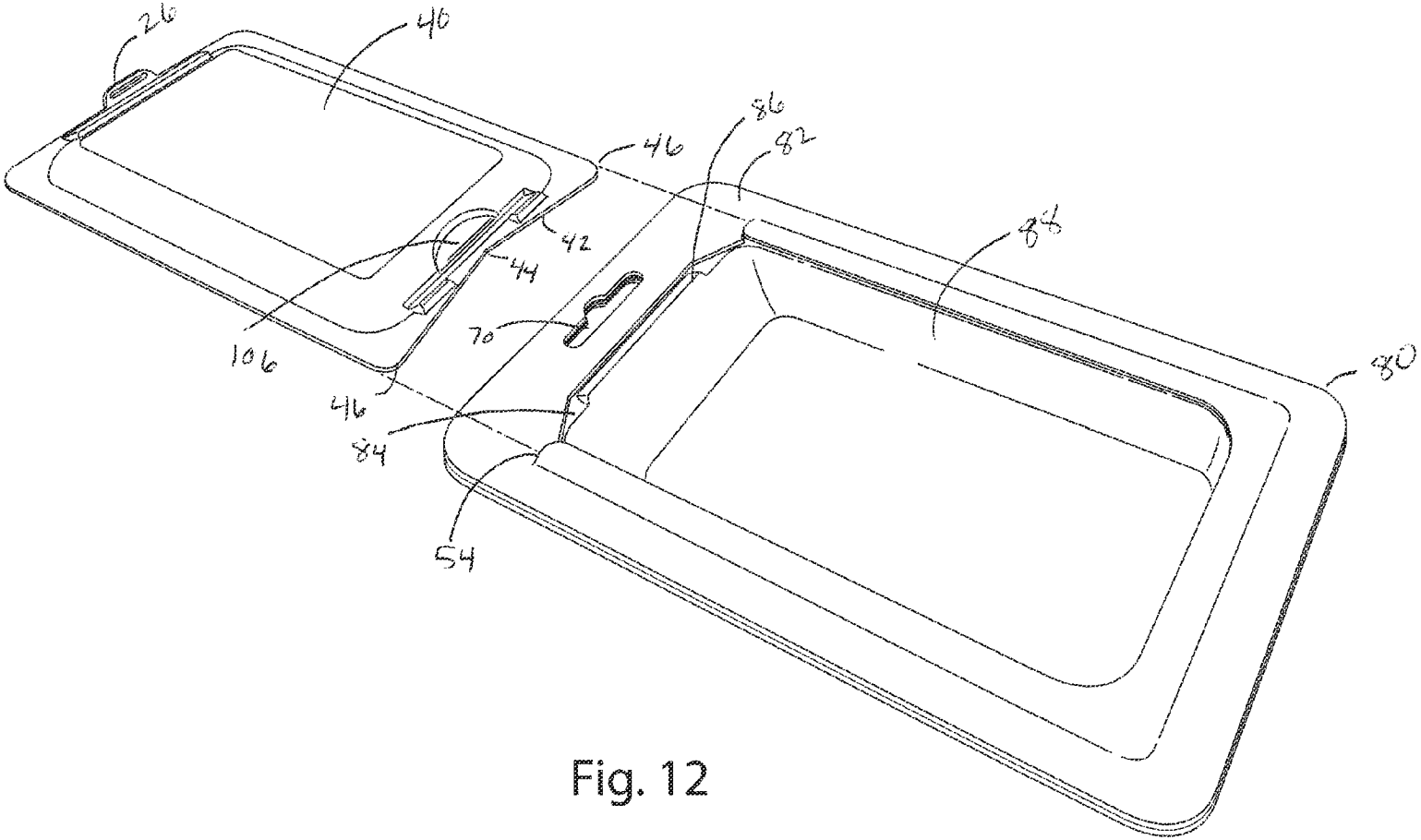
FIG. 12 is a perspective view of the paperboard cut details.

The cover 40 may include a tab 26 as shown in FIGS. 1-3 that is sized and shaped to provide sufficient gripping surface for a user to overcome the resistance to opening or closing the package 10 as presented by snap elements such as ramps 24 and the corresponding depressions 50. Alternatively, or additionally, finger recesses 106 as shown in FIG. 12, may be included for the same purpose. The finger recesses are sized and shaped to allow a user to place a finger or thumb on or near the finger recess 106 and press or slide the cover 40 to overcome the resistance of the snap elements to open or close the package 10.

Although the tray 12 and cover 40 of the illustrated embodiment are generally rectangular, they may vary in shape from application to application as desired. For example, the general shape of the inner or concave portion 22 of the tray 12 that serves as a cavity 20 is rectangular, but may vary depending upon the shape of the article(s) to be packaged or the desired package aesthetics. Similarly, the panel 30 and or panel sides 33 and 34 may have sides or flaps with openings of different sizes or shapes and the two parts of the panel 30 or the panel sides 33 and 34 are not required to be identical. For example, in FIG. 12, a rear portion 82 of a paperboard panel 80 has been cut out to accommodate a catch 86 on the tray 88 that is uncovered by the panel 80. This configuration helps to avoid buckling, wrinkling or tearing of the panel 80. The configuration of FIG. 12 results in the front panel 84 of the panel 80 having an overall smaller opening than the rear panel 82 of the panel 80.

Figure 9:
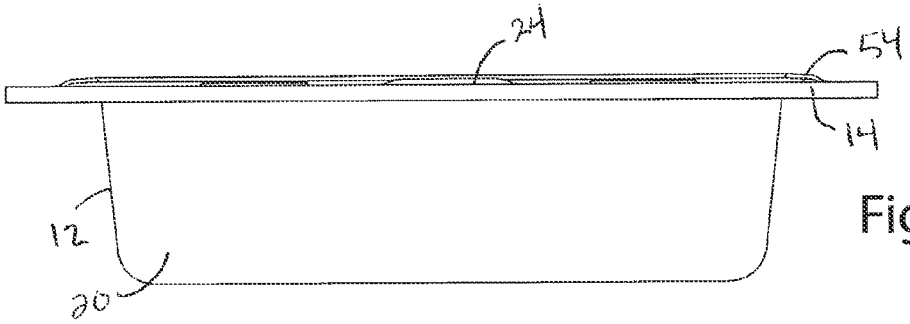
FIG. 9 is an end view of the top of the package.
Figure 10:
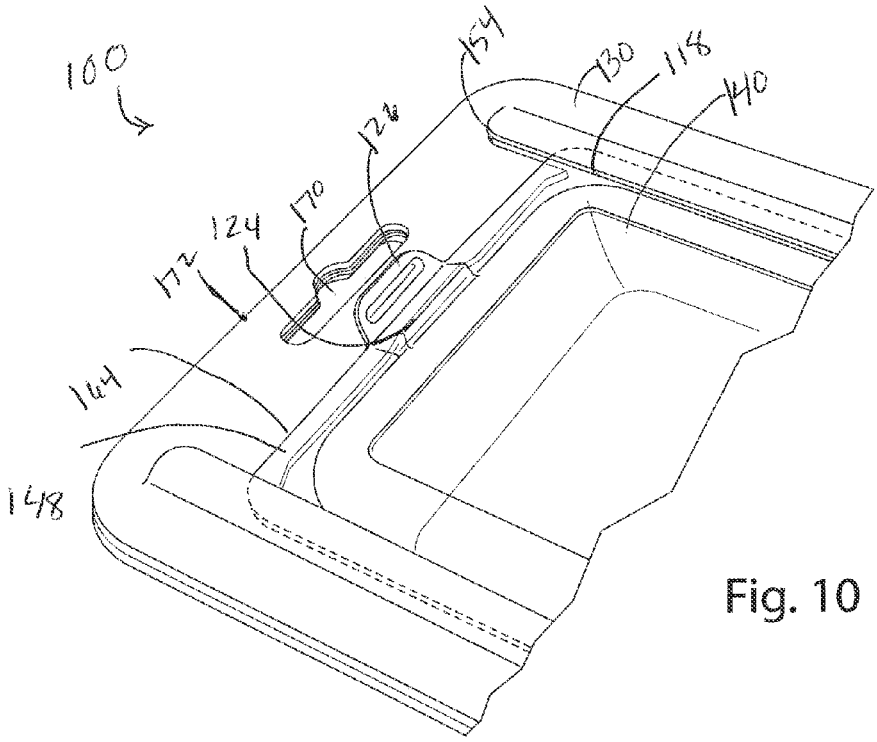
FIG. 10 is a top perspective view of the package with extended notches.
Figure 11:
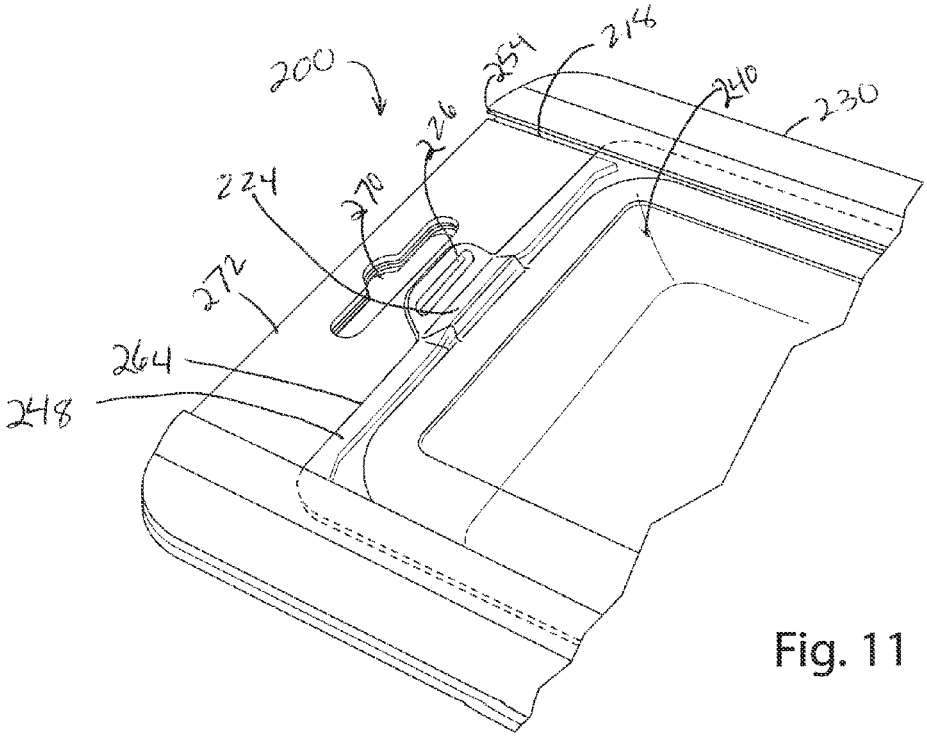
FIG. 11 is a top perspective to the notches extended to the end of the panel.

FIGS. 9-11 include channel guides 54 which are flaps, notches, slits or perforations in the panel 30 that allow a subtle separation from the peripheral tray flange 14. The separation may be caused by the rail 16 or thickness of the peripheral tray flange 14 as described herein in connection with the formation of the channel 18. The channel guides 54 assist the user in guiding the peripheral cover flange 48 or cover 40 into the channel 18. In FIG. 10, the channel guides 154 are positioned to extend from a top edge 164 of the peripheral cover flange 148 toward a hang hole 170 near the top of the package 10. FIG. 11 depicts the channel guides 254 as extending through a top end 272 of the package 200. When engaging the peripheral cover flange 248 or cover 240 with the channel 218, the flange 248 or cover 240 is woven over the panel 230 at the top end 272 of the package 200 and then under panel 230 at the channel guides 254. Referring to FIGS. 10 and 11, positioning the channel guides 154 or 254 above the tray top ramp 124 and 224, for example toward the top of the package 100 or 200 toward the hang hole 170 or 270 end of the package 100 or 200, may ease the start of the peripheral cover flange 148 or 248 into the channel 118 or 218 because the cover flange 148 or 248 would be in a position to engage the channel 118 or 218, or be woven into the channel guides 154 or 254, prior to encountering the tray top ramp 124 or 224 during movement of the cover 140 or 240 toward closing the package 100 or 200.

Additional features intended to ease the cover 40 into place include a leading edge 42 of the cover 40 having a notch 44 formed therein. Formation of the notch 44 allows the extended, leading corners 46 of the cover 40 to move through the channel 18 toward the bottom end of the package and to seat in a closed position and avoid or minimize buckling, wrinkling or tearing of the panel material. These features of the leading edge 42 are depicted in FIG. 3.

Figure 13:
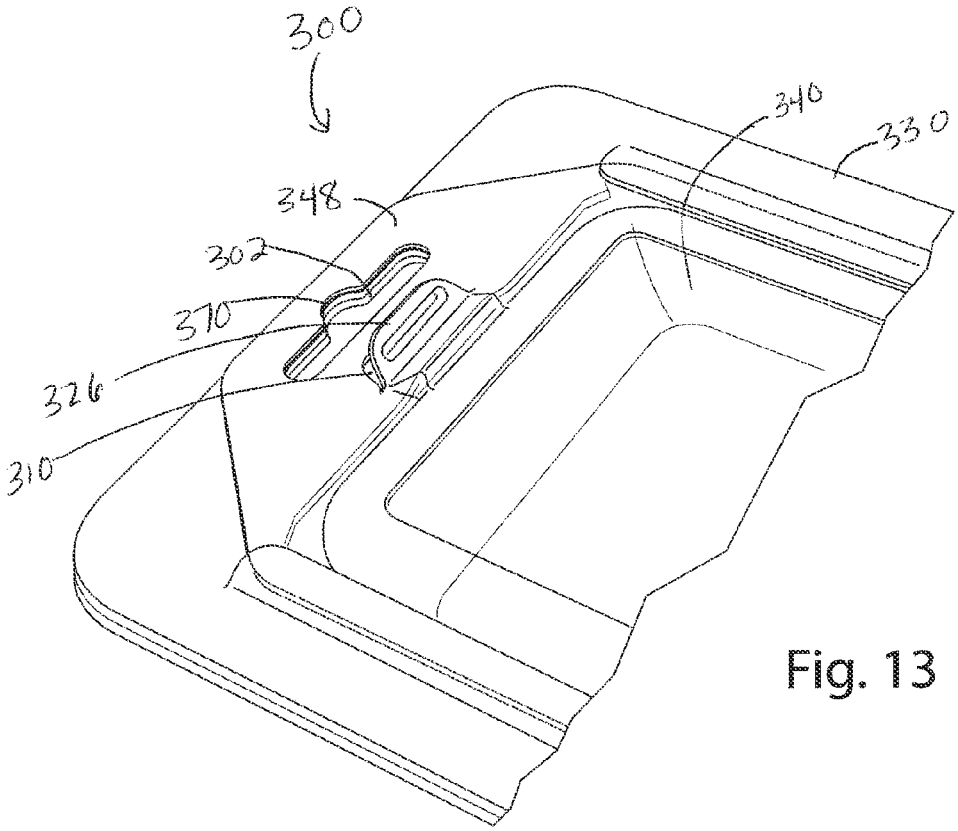
FIG. 13 is a perspective view of an embodiment with a hanging hook and integrated tab on the cover.

As shown in FIG. 13, the cover 340 may have a cover flange 348 extended to include a cover hang hole 370. Similarly, the panel 330 may include a hang hole 302 that allows the package 300 to be easily hung, for example, from a display hook at the point of sale. The hang hole 370 and 302 may vary in size, shape, configuration and location, or it may be eliminated when unnecessary. In the illustrated embodiment, separate openings are defined in the cover 340 and the peripheral tray flange (not shown in FIG. 13). These openings align to form the hang hole 370 and 302 when the cover 340 is positioned so that the package 300 is closed. The embodiment in FIG. 13 ensures that the cover 340 is secured in the closed position prior to the package 300 being displayed on a display rack (not shown) by hanging the package 300. The cover 340 may also include an integrated finger tab 326. The tab 326 is formed by cutting a flap of material from the cover flange 348 leaving a void 310 in the flange 348. The package 300 may be provided with other package features, as desired, such as functional and/or aesthetic features selected to tailor the package for specific applications. For example, the package 300 may be provided with a foot to help it stand upright, a "touch and feel" hole that allows a user to touch and feel the packaged article(s) or any of a wide range of features that might be provided for branding purposes.

Figure 16:
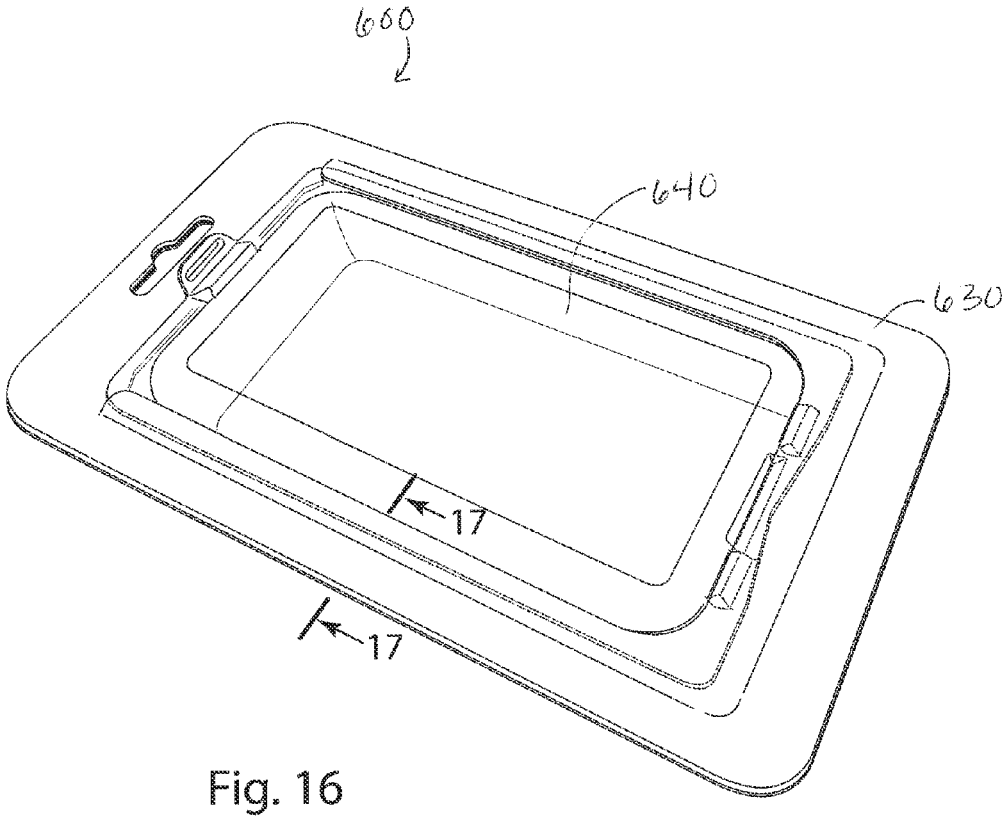
FIG. 16 is a perspective view of the package.
Figure 17:
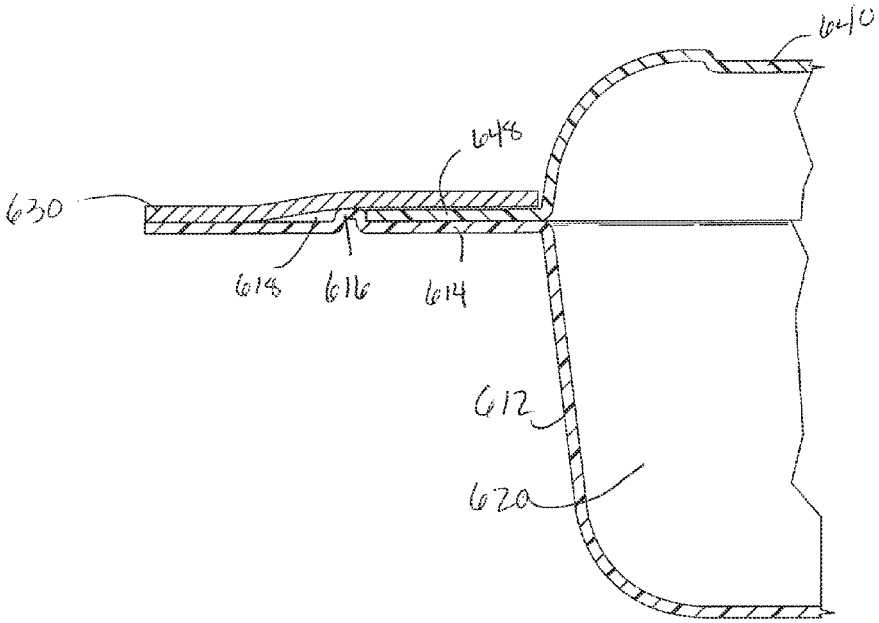
FIG. 17 is a cross-section of the single layer panel option of FIG. 16.
Figure 18:
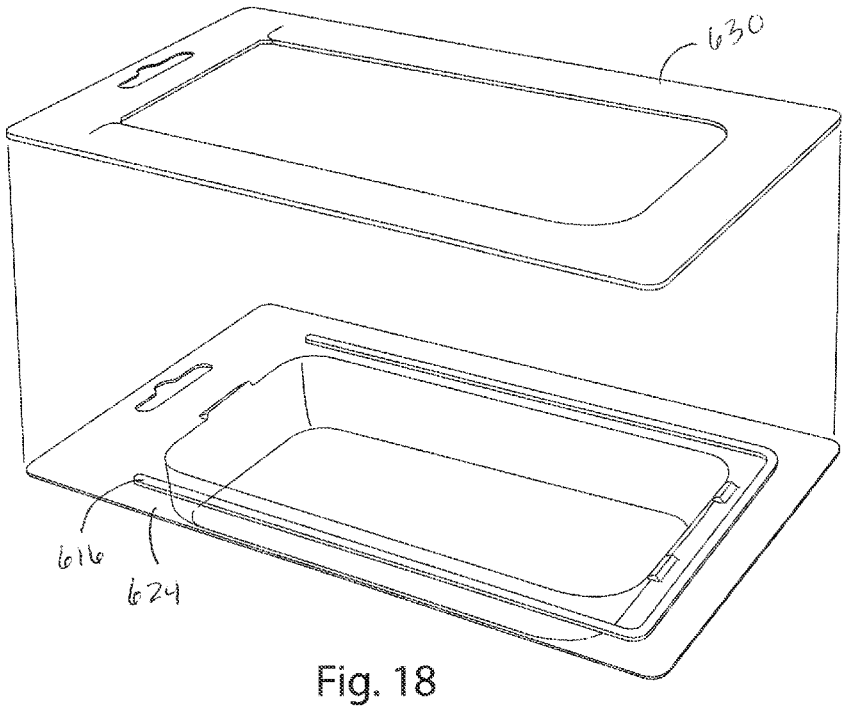
FIG. 18 is an exploded view of the package and single layer panel.

In another embodiment depicted in FIGS. 16-18, a package 600 has a tray 612 with a flange 614 having a rail 616. The panel 630 is a single layer of paperboard attached to at least a portion of the tray flange 614 by adhering with an adhesive or cohesive material or by mechanical means as described herein. In the cross-sectional view of FIG. 17, the panel 630 is adhered to the tray flange 614 and rests on the rail 616 creating a channel 618 comprised of the tray flange 614, the rail 616 and the panel 630. As in the foregoing embodiments, the cover 640 functions as the recloseable door described in the foregoing embodiments by moving along the channel 618 over a range of positions from a completely closed cavity 620 containing a product to a completely open cavity 620 allowing for easy placement or replacement of the product within the package 600.

Figure 19:
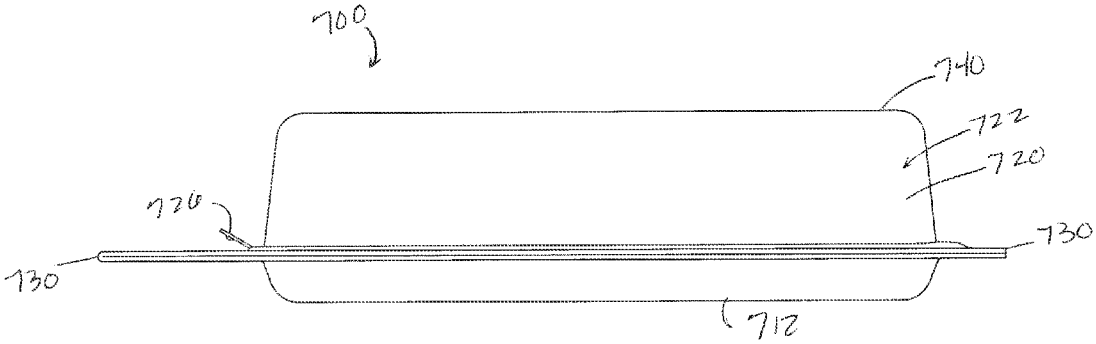
FIG. 19 is a perspective view of the invention with an expanded cover.

As noted above and in FIGS. 1-3, a substantially inner or concave portion 22 of the tray 12 serves as a cavity 20 for containing and displaying a product. The panel 30 is secured about at least a portion of the peripheral tray flange 14 and contacts the rail 16 to form a slot or channel 18 adapted to closely receive and guide the cover 40. An alternative package embodiment is shown in FIG. 19 and is generally designated as 700. The cover 740 may include a substantially inner, concave portion 722 that can serve as a cavity 720 for an article or articles that would be packaged or displayed the package 700. A channel (not shown in FIG. 19) is formed as described herein relative to either FIG. 5A or 5B. The tray 712 of FIG. 19 has a lower profile, or shallower depth, relative to panel 730 as compared to the larger profile of the cover 740 relative to the panel 730 such that any product(s) or articles(s) displayed in the package 700 would be substantially contained with the cavity 720 of the cover 740. However, the tray 712 may similarly include a cavity of a size and shape adequate to support all or a portion of the article(s) or product (s) displayed in the package 700.

The use of directional terms is merely an expedient to facilitate disclosure with reference to the illustrations and should not be interpreted to limit the invention to packages of any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The embodiments of the invention in which an exclusive property or privilege is claimed are as follows:

1. A package for packaging an article comprising:

a tray with a peripheral tray flange;

a rail disposed on at least a portion of said tray flange;

a panel having a primary portion in a primary plane and an off-set portion outside the primary plane, the off-set portion deformed about said rail and engaging at least a portion of said rail forming a channel with said tray flange; and a cover selectively movable in said channel over a range of positions between an open position and a closed position by sliding said cover within said channel, wherein the cover is repeatedly movable between said closed position and said open position without damaging the panel.

2. The package of claim 1 wherein said rail is an integral part of said peripheral tray flange.

3. The package of claim 2 wherein said panel comprises opposing sides folded about a hinge; said opposing sides being interconnected on opposite sides of said peripheral tray flange.

4. The package of claim 1 wherein said panel further comprises a channel guide engaged with a peripheral cover flange of said cover.

5. The package of claim 1 further comprising:

said cover having a leading edge comprised of at least one extended corner;

whereby said cover enters said channel by said extended corner.

6. The package of claim 1 wherein said peripheral tray flange and said cover each further comprise corresponding snap lock fittings; and wherein said snap lock fitting of said peripheral tray flange further comprises a ramp and said snap lock fitting of said cover further comprises a corresponding depression.

7. The package of claim 1 further comprising a tray hang hole integral to said peripheral tray flange.

8. The package of claim 7 further comprising a cover hang hole integral to a peripheral cover flange of said cover, said cover hang hole aligned with said tray hang hole.

9. The package of claim 1 further comprising a tab disposed on said cover.

10. A package for packaging an article comprising:

a tray with a peripheral tray flange;

first and second panels disposed on opposite sides of said tray flange, said first and second panels being interconnected, at least one of said first and second panels being spaced apart from said tray flange to define a channel, at least one of said first and second panels having a primary portion in a primary plane and an off-set portion outside said primary plane, said off-set portion deformed about said peripheral tray flange; and a cover having opposed edges received in said channel and being moveable over a range of positions between an open position and a closed position by sliding said cover within said channel, wherein said cover is repeatedly movable between said closed position and said open position without damaging the first and second panels.

11. The package of claim 10 wherein said first and second panels are spaced apart from said tray flange by a rail integral to said tray flange to define said channel.

12. The package of claim 10 wherein at least one of said first and second panels further comprises a channel guide to engage a leading edge of said opposed edges of said cover.

13. The package of claim 10 wherein said cover having a leading with an extended corner whereby said cover enters said channel by said extended corner.

14. A reclosable composite package comprising:

a tray having an article-receiving cavity and a peripheral flange extending about at least a portion of said cavity;

a panel in a primary plane engaged with said peripheral flange and having an inner portion spaced apart from said peripheral flange, said inner portion outside said primary plane, whereby said inner portion and said peripheral flange cooperatively define a channel; and a cover slidably interfitted with said channel, said cover being movable within said channel between a first position in which said cover closes said cavity and a second position in which said cover opens said cavity, wherein said cover is repeatedly movable between said first position and said second position without damaging the panel.

15. The package of claim 14 wherein said channel includes opposed sections extending along opposite sides of said cavity, said opposed channel sections opening toward one another.

16. The package of claim 14 wherein said cover includes opposite edges fitted into said opposed channel sections.

17. The package of claim 14 wherein said cover and said tray include snapping contours that mate when said cover is in said first position, said contours being shaped to cause said cover to snap-lock into said first position.

18. The package of claim 14 wherein said cover and said tray includes stop contours that interact to resist separation of said cover from said tray.

19. The package of claim 18 wherein said stop contours are configured to abut one another and resist further opening of said cover when said cover is in said second position.

20. The package of claim 14 wherein said cover and said tray include snapping contours that mate when said cover is in said first position, said contours being shaped to cause said cover to snap-lock into said first position; and wherein said cover and said tray includes stop contours that interact to resist separation of said cover from said tray.

21. The package of claim 14 wherein said peripheral flange includes a rail.

22. The package of claim 21 wherein said rail extends along at least a portion of an outer peripheral edge of said tray.

23. The package of claim 14 wherein said inner portion of said panel extends substantially parallel to said peripheral flange.

24. The package of claim 14 wherein said channel includes three sections extending along three sides of said cavity, said cover having three edges being interfitted with said three sections when said cover is in said first position.

25. The package of claim 14 wherein said panel includes two sides disposed on opposite sides of said peripheral flange.

* * * * *

UNITED STATES PATENT AND TRADEMARK OFFICE

CERTIFICATE OF CORRECTION

PATENT NO. : 8,813,959 B2
APPLICATION NO. : 13/739360
DATED : August 26, 2014
INVENTOR(S) : Victor D. Hansen et al.

It is certified that error appears in the above-identified patent and that said Letters Patent is hereby corrected as shown below:

In the Claims,
Column 11, Claim 13, Line 19:
after "leading" insert --edge--

Signed and Sealed this
Sixteenth Day of December, 2014

Michelle K. Lee

Michelle K. Lee
*Deputy Director of the United States Patent and Trademark Office*